US006434788B1

(12) United States Patent
Schulte

(10) Patent No.: US 6,434,788 B1
(45) Date of Patent: Aug. 20, 2002

(54) DOOR CLOSER

(76) Inventor: Ernst Schulte, August-Macks-Strasse 14, DE-58706, Menden (DE)

( * ) Notice: Subject to any disclaimer, the term of this patent is extended or adjusted under 35 U.S.C. 154(b) by 0 days.

(21) Appl. No.: 09/352,968

(22) Filed: Jul. 14, 1999

(30) Foreign Application Priority Data

Jul. 14, 1998 (DE) ..... 198 31 393

(51) Int. Cl.[7] ..... E05F 3/22

(52) U.S. Cl. ..... 16/53; 16/51; 16/58; 16/57; 16/DIG. 9; 16/DIG. 17; 16/DIG. 21

(58) Field of Search ..... 16/51, 53, 58, 16/57, DIG. 9, DIG. 17, DIG. 21

(56) References Cited

U.S. PATENT DOCUMENTS

| | | | | |
|---|---|---|---|---|
| 1,085,422 A | | 1/1914 | Hills | |
| 4,064,589 A | * | 12/1977 | Bejarano | 16/53 |
| 5,187,835 A | | 2/1993 | Lee | |
| 5,651,162 A | * | 7/1997 | Keszthelyi | 16/51 |

FOREIGN PATENT DOCUMENTS

| | | | |
|---|---|---|---|
| DE | 1 96 144 | | 11/1906 |
| DE | 2 89 981 | | 3/1914 |
| DE | 9 36 912 | | 12/1955 |
| DE | 1042425 | * | 12/1956 |
| DE | 195 00 382 A1 | | 2/1996 |
| DE | 195 48 202 A 1 | | 10/1997 |
| DE | 196 20 382 A1 | | 11/1997 |

* cited by examiner

*Primary Examiner*—Anthony Knight
*Assistant Examiner*—Matthew E. Rodgers
(74) *Attorney, Agent, or Firm*—Woodbridge & Associates, P.C.; Richard C. Woodbridge

(57) ABSTRACT

The invention describes a door closer with an energy storage that includes a resisting spring (3), with a closer shaft (1) driven by the resisting spring (3) and with an hydraulic fluid damped damping device (12, 13), whereby the energy storage and the damping device (12, 13) act upon a common closer shaft (1), whereby the resisting spring (3) and the closer shaft (1) are not in contact with the fluid of the damping device (12, 13). In this way a particularly slim housing is possible.

2 Claims, 2 Drawing Sheets

DOOR CLOSER

CROSS REFERENCE TO RELATED APPLICATIONS

This application claims the priority of a German patent application filed Jul. 14, 1998 bearing application no, 19831393.4.

BACKGROUND OF THE INVENTION

1. Field of the Invention

The present invention concerns a door closer.

2. Description of Related Art

This type of door closer is known, for example, from DE 9319541 U1 that originated with the inventor. In that publication a door closer is described which exhibits a resisting spring and an hydraulic damper/attenuation element. The resisting spring acts directly on the damper piston and together with it operates in a common housing. The closer shaft is provided with a pinion that enmeshes with internal dentition in the damper piston.

In practice, two problems emerge from this type of construction. On the one hand, the thickness of the door closer in the radial direction of the closer shaft is relatively large, since the damper piston surrounds the closer shaft. On the other hand the resisting spring is situated in one portion of the damper device and is in contact with the hydraulic fluid. In the event of a defect or a leak in the damper device the part of the door closer that is associated with resisting spring must therefore also be opened. The high repair cost that is incurred by this procedure generally results closer in the necessity of complete replacement of the door closer.

In DE 198 20 382 A1 a door closer is described that exhibits an energy storage [i.e., reservoir] in the form of a resisting spring that is present but separated from the closer shaft via a pulling means. A damper device is not provided for in this type of door closer.

DE 195 482 02 A1 shows a friction damper for that type of door closer that must be provided separately in a guide rail of the closer assembly. Such a friction damper does not achieve the desired closing process that can be obtained using hydraulic damper/attenuation element.

It is therefore the purpose of the present invention to create a door closer that has a streamlined construction. In addition, the present invention seeks to create a door closer in which the drive assembly and the damping assembly can be separated from one another in a simple manner.

These tasks are solved by the door closer having the characteristics set forth in this application and the related claims.

SUMMARY OF THE INVENTION

Because the resisting spring and the closer shaft are not in contact with the fluid of the damper device they are not affected by the dynamic pressure occurring with the operation of the damper device. The resisting spring and the closer shaft can therefore be arranged in a relatively simple configuration, particularly in housings that are not fluid-tight that are furthermore of a thin-walled execution. Because of this there is a material and labor cost advantage at the time of manufacture. Furthermore, the minimal wall thickness of the housing in the area of the energy storage reduces the overall dimension and the weight of the door closer.

If the energy storage, the closer shaft, and the damper device are consolidated in a common structural unit the housing sections can be adapted to the individual requirements of the components with respect to their design and the thickness of their walls. They can, however, be mounted together on the door or on the frame as is done in a conventional door closer. The resisting spring can operate via a driver, especially by way of a chain on the closer shaft. This provides a simple, economical, and reliable transmission of power.

Depending on the installation situation it may be advantageous if the damper device is arranged in a radial direction next to the closer shaft or if the damper device is set up in the axial direction to the closer shaft. Likewise it can sometimes be advantageous if the closer shaft is situated between the resisting spring and the damper device. On the other hand the arrangement of the damper device and the energy storage on the same side of the closer shaft may be beneficial. The closer shaft is then located as far as possible to the end of the housing.

It is a further advantage if the damping/attenuation device includes a damper piston that is driven by a rod, for example, by a linkage. In this case the damping/attenuation device and the resisting spring can be arranged parallel, especially coaxially, in their effective direction. The forces [i.e., moments] acting on the closer shaft can be effectively balanced. Satisfactory kinematics and flat construction of the door closer, particularly in the axial direction, is possible if the closer shaft can be rotated around an axis that is placed essentially perpendicular.

Particular benefits are obtained if the damping/attenuation device is arranged with its separate housing section so as to rotate around the resultant direction. Depending on the installation setting the damping/attenuation device with its adjustment valves can then be so oriented such that they can be adjusted from an accessible side of the doorframe or the door panel. The housing section surrounding the damping/attenuation device in the direction of the closer shaft can carry an annular running collar facing outward, which catches the open groove towards the shaft and with it forms a rotational bearing. It is beneficial if the resisting spring is a helical spring that is externally encased in a sleeve, whereby the end of the sleeve facing the closer shaft forms an inward connection that is formed as a counter bearing/end stop for the resisting spring. Furthermore, the initial torque (pre-stressing) of the resisting spring can be adjusted by way of an adjusting device acting on the end of the sleeve opposite to the closer shaft. In this manner a simple and operationally reliable adjustment contrivance is provided.

If the pulling means at least segmentally opposes the jacket surface of the covering of the closer shaft, then the jacket surface preferably exhibits a angular-dependent varying distance from the middle axis of the closer shaft. The effective lever or balance arm, with which the drivers is engaged at the closer shaft, can be almost freely adjusted. It is therefore advantageous if the effective lever arm of the drivers is coarsest at the closer shaft in the area of low door opening angle. This can be achieved particularly effectively in that the drivers engages the closer shaft in the area of low door opening angle via a lever, so that a somewhat cosinusoidal torque is achieved, the drivers abuts the closer shaft at a greater opening angle, so that the moment [i.e., inertia] from that point does not essentially further diminish.

A good comfort level on opening the door in the area of medium door opening angle is provided if the effective lever arm of the drivers at the closer shaft in the area of medium door opening angle. In addition the effective lever arm can increase to an excessively large door opening angles. When this happens an increase of the opening power in the case of an opened door is attained. Although this condition does not kinematically limit the door opening angle it nonetheless prevents the door, at constant force, from striking against an obstacle.

When doing so the variation of the lever or balance arm can be ascertained quite easily by way of the thickness and/or form of the drivers, particularly concerning the different lengths of links of a drive chain. There are multiple possible variations are that are overall inexpensively accessible.

In the following a design example of the present invention is described in detail referring to the drawings.

DETAILED DESCRIPTION OF THE PREFERRED EMBODIMENT

Figure 1:
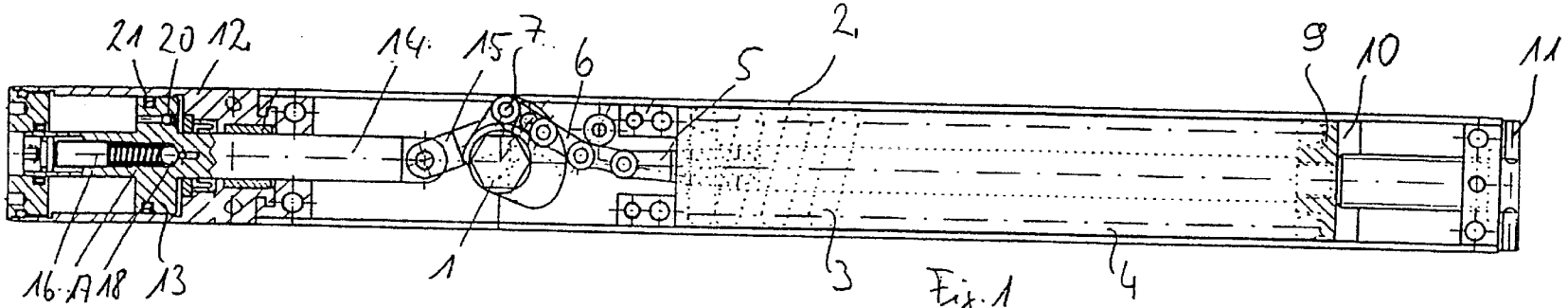
FIG. 1: A door closer as described in the invention in cross section from above.

In FIG. (1) a door closer is shown in cross section. A closer shaft (1) is arranged so that it can be rotated in a housing (2), whereby the rotational axis is on the diagram level according to FIG. 1.

The closer shaft (1) divides the housing (2) approximately in the proportion ⅔:⅓ into a longer housing section and a shorter housing section. The longer housing section encloses a resisting spring (3) that is surrounded by a sheath (4) and run through by a drive rod (5). A drive chain (6) connects the drive rod (5) with the closer shaft (1) as drivers. The drive chain (6) engages a bearing (7) at a distance from the middle axis of the closer shaft.

At the end closer to the shaft the resisting spring (3) is protected at a floor (8) of the sheath (4). The end remote from the shaft of the resisting spring (3) lies on a spring seat (9) that is tensile-connected to the drive rod (5). The sheath (4) is tensile-connected with an adjusting screw (11) by way of a cover (10). The adjust screw (11) is supported against the remote end of the housing (2) in front.

The shorter housing section contains a damping/attenuation device with a cylindrical housing section (12) that encloses a damping piston (13). The damping piston (13) is connected to a piston rod in one-piece, which in turn is connected with a connector element (15) and thereby connected to the closer shaft (1). The point of action of the connecting element (15) at the closer shaft (1) lies directly adjacent to the point of action (7) such that a lever arm results between the connecting element (15) and the closer shaft (1). The damping element furthermore includes a conventional adjusting screw (16) that retains a valve ball (18) in its seat by means of a pressure spring (17). In this manner a pressure limiting valve is created, which on rapid opening or closing of the door the resulting internal pressure is limited. Furthermore, the piston (13) contains a one way, spring biased recoil valve (20) that allows opening of the door without damping; however in the direction of closing the valve is closed. Finally, the piston (13) encloses an annular seal (21) for the purpose of separation of the two operating spaces of the hydraulic fluid.

Figure 2:
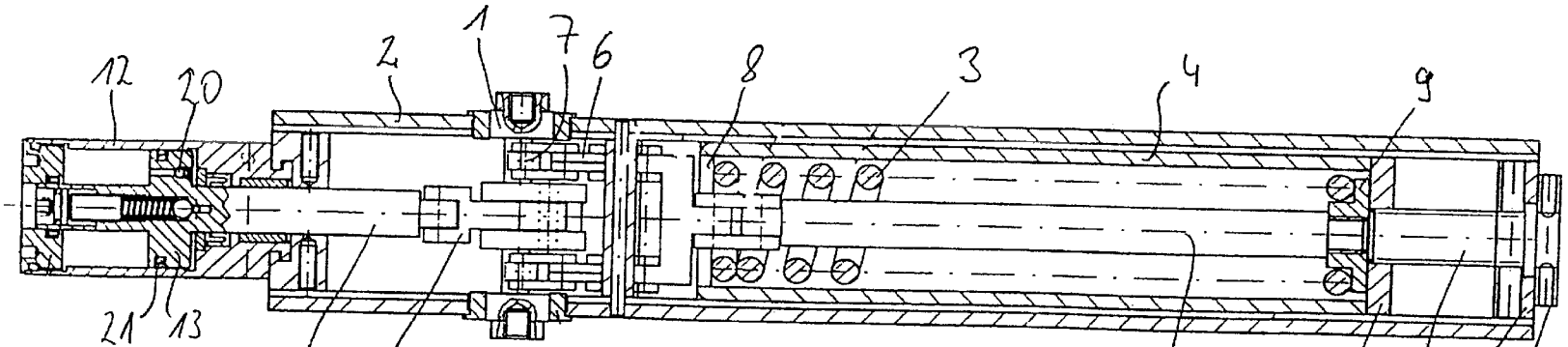
FIG. 2: The door closer according to FIG. 1 in cross section from the side.

FIG. 2 shows the door closer of FIG. 1 in cross section parallel to the rotational axis of the closer shaft (1). Identical elements are identified using identical reference numbers.

It is clear that the drivers of the resisting spring, the chain (6), is executed in duplicate and engages above and below in FIG. 2 at the closer shaft, while the connecting element (15) is executed singly and engages midway between the two sections of the chain (6) at the closer shaft.

Figure 3:
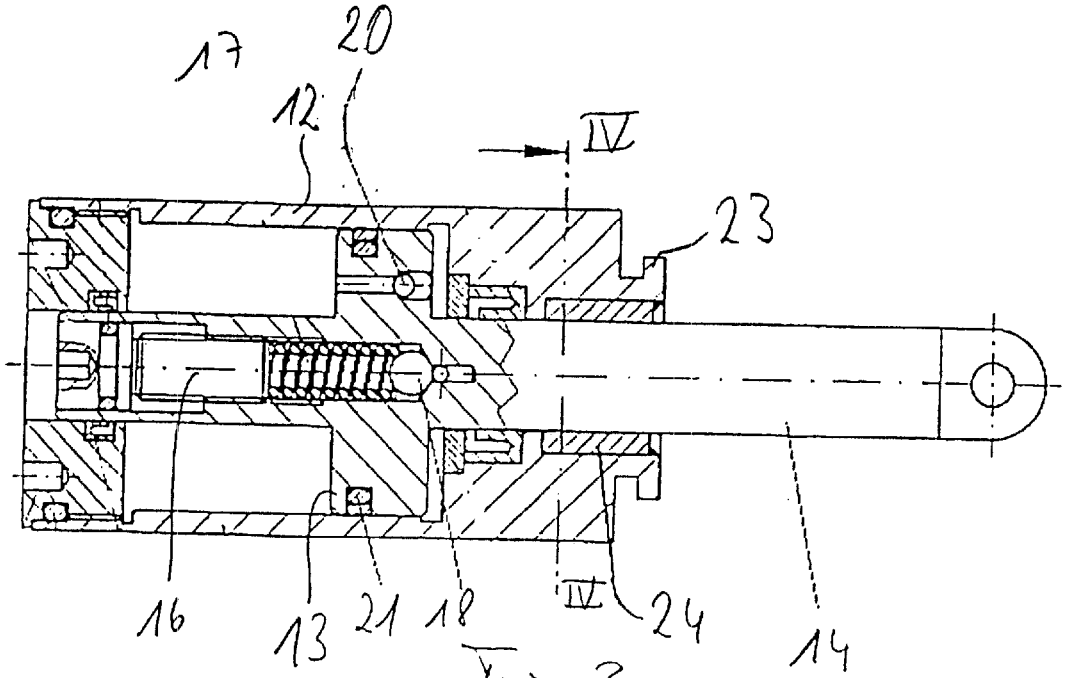
FIG. 3: The damping/attenuation device of the door closer in an enlarged view according to FIG. 1, and FIG. 4: A cross section through the damping/attenuation device along the line IV—IV from FIG. 3.

FIG. 3 shows the damping/attenuation device in cross section according to FIG. 1 in an enlarged detail. It can be seen that the housing section (12) in the area of the passage of the shaft (14) is provided with an outward-facing collar (23) that essentially surrounds the shaft (14) with rotational symmetry. A glide bushing (24) is situated between the shaft (14) and the housing section (12) that assumes control over the guidance of the shaft (14).

Figure 4:
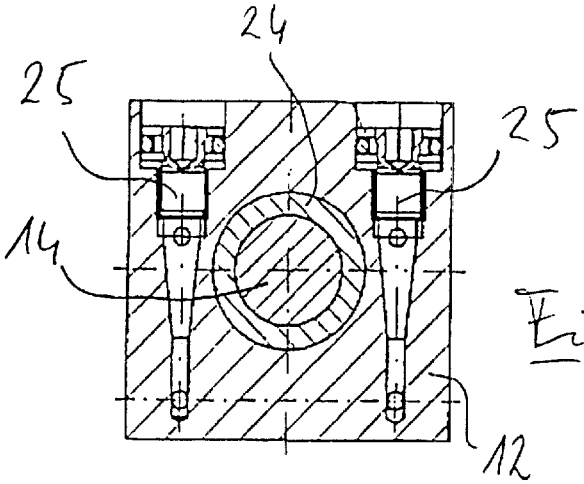

FIG. 4 shows the damping/attenuation device of FIG. 3 in cross section along the line IV—IV. It is clear in this instance that two adjustable choke valves (25) are situated laterally near the guide of the shaft (14). These choke valves (25) assist in the adjustment of the degree of damping whereby one operates over the entire opening range of the door while the second valve becomes active in the angular range shortly before closing of the door and, reduces the damping in that angular range so that engagement of the door in the frame occurs very quickly.

In practice the door closer so far described operates as follows: A lever installed on the door or a shear linkage, that is associated with the door, moves in a counter-clockwise direction when the door is opened, as shown in FIG. 1, so that the closer shaft (1) turns counter-clockwise. The closer shaft (1) is stressed against the counter bearing (8) via the drivers (8), the drive rod (5) and spring seat (9). In this way the energy required for closing the door is stored. The damping element is pressed to the left via the connecting element (15) and the shaft (15) in FIG. 1, whereby the hydraulic fluid flows from one operational volume into the other operational volume through the one-way, spring biased valve (20) without accumulating notable damping resistance. Subjectively opening of the door alone against the resistance of the resisting spring (3) effects and results in essence velocity-dependent inertia. On return to the resting position, as is illustrated in FIG. 1 and FIG. 2, the resisting spring (3) expands against the spring plate (9) and pulls via the drive rod (5) and the drivers (6) at the point of action (7) of the closer shaft (1). This effects a torque in a clockwise direction as shown in FIG. 1 so that the door connected to the door closer is closed. In the process the door closer is damped because the piston (13) must move the fluid not through the one-way, spring biased, recoil valve (20), but over the adjustable choke valve (25) into the left operational chamber. This results in a damping of the closing action and thus in a limitation of the closing speed. At the last instant of the closing process, when the closer shaft (1) has essentially reached the position shown in FIG. 1, the lever arm between the point of action (7) and the rotational axis of the closer shaft (1) is particularly large and on the other hand the second choke valve (25) actuates parallel to the first choke valve so that the damping is reduced. Both effects cause an increase in the closing inertia of and the closing speed so that the resistance of a possible resistant doorframe is safely overcome.

In the door closer so far described, there is the benefit that the entire housing section (12) is rotational around its middle axis as defined by axis of the shaft (14), since the collar (23) engages in the appropriate groove of the longer housing section. In this manner the choke valves (25) can be rotated into any orientation. Independent of the installation location of the door closer the housing section (12) can be rotated in such a manner that the choke valves (25) are accessible. Furthermore, it is advantageous that the housing dimension, that is illustrated as the width in FIG. 1, is determined essentially only by the lever/balance arm between the closer shaft (1) and the point of action (7). The door closer described thus far is of a rather narrow build and can easily be incorporated into a door panel without protruding from it. Optically, therefore, the door closer is practically invisible.

Another basic advantage of the illustrated arrangement lies in the modularity of the construction, in that namely the door closer is characterized by an energy storage on the one side of the closer shaft and a damping element on the other side of the closer shaft. In the event of occurrence of leakage of the damping element it can be taken off of the actual door closer and repaired or exchanged without the rest of the door closer having to be taken apart. Finally in the area of the energy storage, e.g. the resisting spring (3), there are no particular precautions necessary in order to assure that there is no escape of hydraulic fluid. There is no hydraulic fluid is in this portion of the door closer. This ultimately makes possible a relatively simple construction for the purpose of adjustment of the initial tensioning of the resisting spring (3). The adjustment screw (10) can actually pull away from the closer shaft (1), via a threaded section, (26) (illustrated in FIG. 2) the entire sheath (4) with the base (8). Thus the initial stressing of the resisting spring (3) is increased and this results in a greater closing inertial with a small opening angle of the door.

Overall there is one door closer with a minimal installation dimension diagonal to the closer shaft that can be reduced to about 40 mm. Thus the door closer is suitable for installation into a door panel. There also results a door closer that is characterized by a relatively simple mechanical construction in that the two functional groups are separated from one another and fluid tightness is required only in the damping section. The modular construction is particularly easy to repair. Finally the door closer is adaptable for several installation positions without alterations.

The pressureless and non-leakproof to fluids housing of the energy storage can be kept rather slim, whereby even in relatively minimal dimensions a relatively powerful resisting spring can be incorporated. In this manner, in comparison to conventional door closer having identical installation thickness, greater inertia can be attained. The housing can be constructed from easy to fabricate die-formed pieces. This is particularly economical. The modular construction has its advantages for the fabrication process in that a common damping element can be used for various drives so that in the case of door closer with other rotational ranges only the energy storage and drive unit must be changed, while an identical damping element as that in other models can be used.

The necessarily fluid-tight capsule of the energy storage makes possible a direct optical control of the position of the spring pre-stress by way of a peek hole or an indicator pin. Up to now pickup of the initial stress was a mechanically demanding problem that, for example, was resolved by using magnetic transfer of the position of the counter-bearing outwards. A simple visual inspection is again not only particularly cost effective, but in practical terms very desirable, since the initial adjustment of the door closer for a particular size of door is an important aspect in fire and smoke protective doors. Unsatisfactory identification of the spring pre-tension results in such cases in incorrect basic adjustments and corresponding breaches of safety.

I claim:

1. A door closer comprising:

an energy storage means having a resisting spring (3);

a closer shaft (1);

a first housing for housing said energy storage means and said closer shaft (1);

a drive means for connecting said resisting spring (3) and said closer shaft (1), and driving said closer shaft (1);

a hydraulic fluid-damped damping device;

a damper shaft (14);

a second housing (12) for housing said hydraulic fluid-damped damping device said damper shaft (14) comprising;

an externally oriented, annular, circumferential collar (23) that fits into a ring-shaped groove opening in said first housing (2) and along with said first housing forms a rotary bearing; and, a connecting means (15) for connecting said hydraulic fluid-damped damping device with said closer shaft (1), wherein said energy storage means and said closer shaft (1) are not in contact with the fluid of said fluid-damped damping device, and wherein said second housing (12) is situated to be able to rotate around its middle axis as defined by the axis of said damper shaft (14).

2. A door closer comprising:

an energy storage means having a resisting spring (3) comprising:

a helical spring that is externally enclosed in a sheath (4) wherein the end of said sheath (4) in the direction of the closer shaft (1) forms a connection (8) directed inward that is formed to be a counter bearing for the resisting spring (3);

a closer shaft (1);

a first housing for housing said energy storage means and said closer shaft (1);

a drive means for connecting said resisting spring (3) and said closer shaft (1), and driving said closer shaft (1);

a hydraulic fluid-damped damping device;

a damper shaft (14);

a second housing (12) for housing said hydraulic fluid-damped damping device said damper shaft (14); and, a connecting means (15) for connecting said hydraulic fluid-damped damping device with said closer shaft (1), wherein said energy storage means and said closer shaft (1) are not in contact with the fluid of said fluid-damped damping device, and wherein said second housing (12) is situated to be able to rotate around its middle axis as defined by the axis of said damper shaft (14).

* * * * *